US008404018B2

(12) United States Patent
Cao et al.

(10) Patent No.: US 8,404,018 B2
(45) Date of Patent: Mar. 26, 2013

(54) BURNER AND METHOD FOR PROCESSING OXIDIZABLE MATERIALS

(75) Inventors: Jin Cao, Allentown, PA (US); Russell James Hewertson, Wescosville, PA (US); Xiaoyi He, Orefield, PA (US)

(73) Assignee: Air Products and Chemicals, Inc., Allentown, PA (US)

( * ) Notice: Subject to any disclaimer, the term of this patent is extended or adjusted under 35 U.S.C. 154(b) by 0 days.

(21) Appl. No.: 12/828,562

(22) Filed: Jul. 1, 2010

(65) Prior Publication Data

US 2011/0154950 A1 Jun. 30, 2011

Related U.S. Application Data

(60) Provisional application No. 61/223,155, filed on Jul. 6, 2009.

(51) Int. Cl.
*F23C 7/00* (2006.01)
*C22B 9/05* (2006.01)

(52) U.S. Cl. ..... 75/414; 266/44; 431/8

(58) Field of Classification Search ..... 75/414; 266/44, 222, 268; 431/8
See application file for complete search history.

(56) References Cited

U.S. PATENT DOCUMENTS

| | | | | |
|---|---|---|---|---|
| 4,927,357 | A | 5/1990 | Yap | |
| 5,563,903 | A | 10/1996 | Jebrail et al. | |
| 5,833,447 | A | 11/1998 | Bodelin et al. | |
| 6,126,438 | A | 10/2000 | Joshi et al. | |
| 6,190,158 | B1 * | 2/2001 | Legiret et al. | 431/8 |
| 6,331,107 | B1 | 12/2001 | Philippe | |
| 6,705,117 | B2 * | 3/2004 | Simpson et al. | 65/134.4 |
| 2007/0254251 | A1 * | 11/2007 | Cao et al. | 431/10 |

FOREIGN PATENT DOCUMENTS

| | | | |
|---|---|---|---|
| CN | 1148151 | A | 4/1997 |
| EP | 0754912 | A2 | 1/1997 |
| EP | 1094273 | A1 | 4/2001 |
| EP | 0748982 | | 8/2002 |
| WO | 2010003866 | A1 | 1/2010 |

* cited by examiner

*Primary Examiner* — George Wyszomierski
*Assistant Examiner* — Tima M McGuthry Banks
(74) *Attorney, Agent, or Firm* — Michael K. Boyer

(57) ABSTRACT

Burner assembly for use in industrial heating and melting applications of material susceptible to oxidation at elevated temperatures is comprised of a flow passage of oxidant surrounded by an annular flow passage of fuel whereby the oxidant is substantially contained inside the fuel layer up to at least 5 oxidant nozzle diameters downstream of the burner outlet in order to minimize contact between the oxidant and the furnace load.

13 Claims, 7 Drawing Sheets

CFD modeling results of oxygen vs. CO for different burner configurations

Experimental verification of CFD modeling predictions on the relationship between CO and oxygen Lab testing of different burner configurations as compare with CFD: Oxygen Lab testing of different burner configurations as compare with CFD: CO Oxygen concentration at the melt as a function of NG burner nozzle angle with 1" nozzle offset Comparison of oxygen concentration at the charge surface in a rotary furnace, with the conventional burner and with the burner of Fig 1.

BURNER AND METHOD FOR PROCESSING OXIDIZABLE MATERIALS

CROSS-REFERENCE TO RELATED APPLICATIONS

This application claims the benefit of Provisional Application No. 61/223,155, filed on Jul. 6, 2009. The disclosure of this application is hereby incorporated by reference.

BACKGROUND OF THE INVENTION

The instant invention relates to burners and methods of using burners for heating and melting an oxidizable material.

Various burners and methods are known in this art for heating and melting oxidizable materials such as aluminum. One such method is described in U.S. Pat. No. 5,563,903 (hereby incorporated by reference), that describes a process where a layer of non-oxidizing gas is injected between the flame and the aluminum being melted. The non-oxidizing gases include a variety of inert gases or fuels.

EP Patent No. 0748982 (hereby incorporated by reference), describes a process where the burner used to melt the aluminum is allowed to run at sub-stoichiometry to create a reducing atmosphere above the aluminum. The remaining oxidant required for combustion is injected through a separate stream above the burner.

The primary concern associated with combustion equipment used in processes such as aluminum melting or recycling is the metal yield. Aluminum is easily oxidized, and the oxidation process is accelerated at elevated temperatures found in a furnace or melter. Aluminum metal loss due to oxidation is so expensive that furnace operators often operate burners used to heat the furnace in a fuel-rich manner in order to minimize free oxygen found in the furnace.

There is a need in this art for burners and methods for heating materials such as aluminum that minimizes oxidation of such materials thereby increasing the material yield.

BRIEF SUMMARY OF THE INVENTION

The instant invention solves problems associated with conventional burners and methods by providing a burner configuration wherein fuel shields (e.g., surrounds), the oxidizer (e.g., oxygen-enriched air or industrial oxygen). By shielding the oxygen with fuel, such reduces the ability of oxygen to come into contact with material to be heated (also known as the "charge" or "load"). The instant burner and methods can reduce the amount of material that is oxidized thereby increasing the material yield.

One aspect of the invention relates to an improved method and apparatus for heating and melting of materials susceptible to oxidation at elevated temperatures. An example of such a process is secondary aluminum melting wherein solid aluminum (e.g., recycled or scrap aluminum), is melted in a furnace by direct heating using a flame. The flame used in such a process is generally located relatively close to the load to maximize radiation heat transfer from the flame to the load; the rate of which scales with the distance squared. The burners of the instant invention provide heat while minimizing any interaction between oxygen, which is used for combustion to generate heat, and the material being heated and, in the case of recycling materials, increase the amount of useful material that is recovered.

One aspect of the invention relates to a process for heating a charge of material comprising:

providing a charge of material to be heated, combusting an oxidant and a fuel by using a burner wherein the oxidant is supplied to the burner in a manner such that the fuel substantially surrounds the oxidant thereby providing a fuel rich zone adjacent the charge, heating the charge by radiant transfer of heat from the combustion to the charge, and;

recovering heated material.

In one aspect of the invention, relates to using a burner having a co-axial configuration where one gas stream completely or substantially wraps around a second gas stream. This aspect uses an annular flow of fuel enveloping a central core of oxidant or oxidizer flow in such a manner that the oxidant core remains shielded by a fuel layer until it has substantially reacted with the fuel.

Another aspect of the invention relates to a process for heating a charge of oxidizable material comprising:

providing a charge of material to be heated, combusting an oxidant and a fuel by using a burner which comprises at least two co-axial conduits wherein the oxidant is supplied by a first conduit and the fuel is supplied by a second conduit and the second conduit substantially surrounds the first conduit and said combusting is performed under conditions sufficient to prevent said oxidant from oxidizing the material, heating the charge by radiant transfer of heat from the combustion to the charge, and;

recovering heated material.

DETAILED DESCRIPTION OF THE INVENTION

Figure 1:
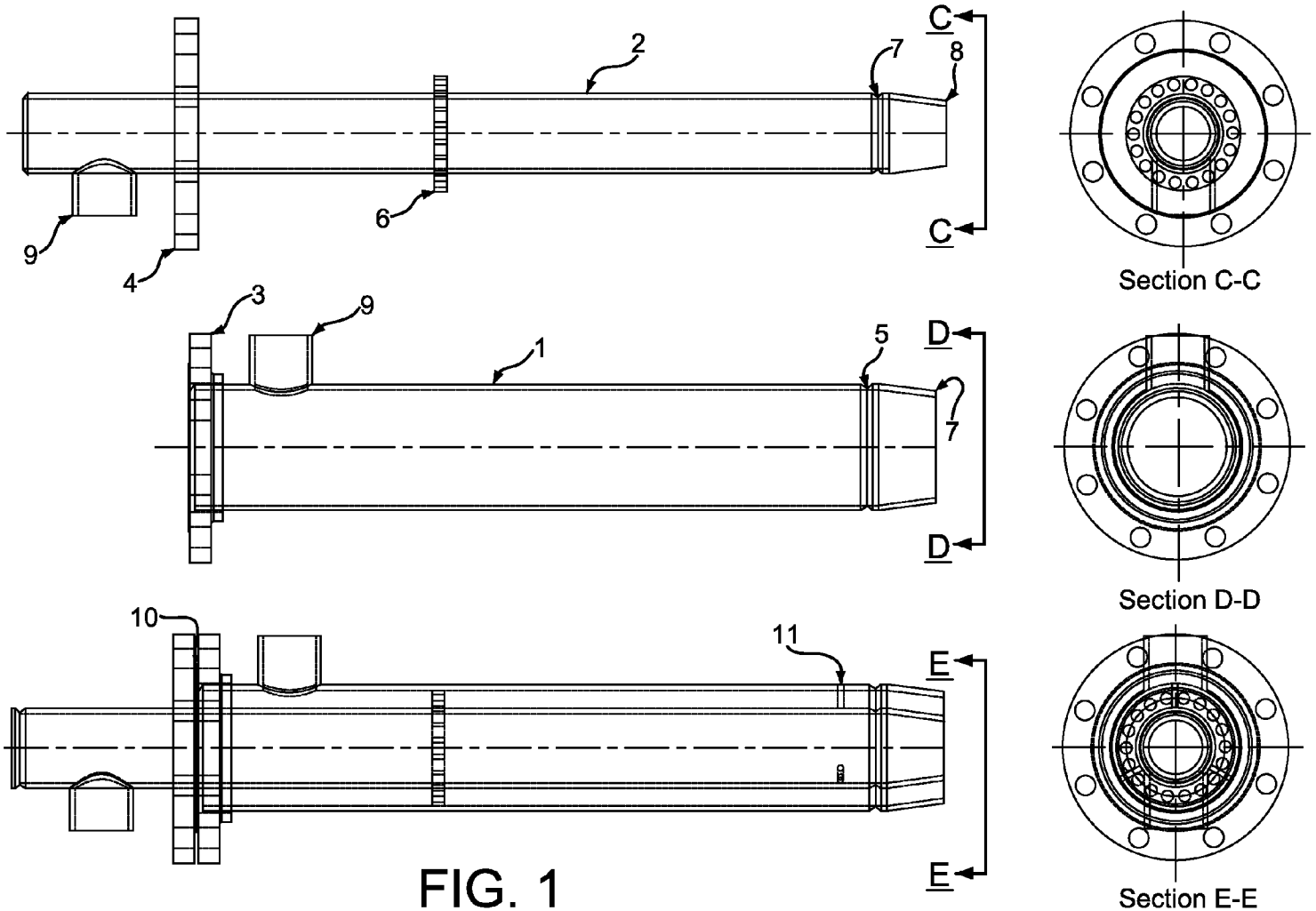
FIG. 1 is a schematic drawing of one aspect of the inventive burner.

This invention relates to an improved combustion method and burner design for heating and melting materials susceptible to high temperature oxidation. The invention has particular utility when used with oxy-fuel burners in the melting and heating of metal products. The instant invention can reduce the concentration of oxidant (e.g., oxygen) that is adjacent to the surface of a charge within a furnace. By "adjacent" it is meant an area or a zone of gas in contact with the surface of the charge wherein the concentration of oxidant in the area controls the oxidation rate of the charge. "Oxy-fuel" herein is defined as the use of pure oxygen (90% or higher oxygen content in the oxidant), or oxidant with high level of oxygen enrichment (oxidant containing 35% volume of oxygen or more) for the combustion of fuel. The fuel combusted in accordance with this invention is typically gaseous or that which can be transported with the aid of a conveying gas, such as finely atomized liquid or finely pulverized solid fuel. An example of a suitable gaseous fuel comprises natural gas. By "metal products" here is defined as metals that are oxidizable including aluminum, iron, lead, nickel, tin, and zinc, alloys containing one or more of the foregoing, among other metals susceptible to reaction losses when heating or melting.

An example of a burner design which can be employed with this invention can comprise a generally co-axial type where one of the gas streams flows through a central conduit completely or substantially completely surrounded by an annular conduit for the other gas stream. The outer annular flow comprises fuel or predominantly fuel, and the central flow comprises oxidant or predominantly oxidant. The shapes of the burner conduits can be circular or any of the other types, such as square, rectangle, or other polygons. The shapes do not have to be symmetric, although asymmetricity can introduce design difficulties and performance issues and so is not preferred. The central and annular conduits can be of different types of shapes, such as an oval shaped central conduit surrounded by a circular annulus, or a circular central conduit surrounded by a rectangular annulus. It is typically desirable to employ self-similar shapes for the central and annular conduits for the least amount of anisotropy around the burner axis. Furthermore, the central burner conduit does not need to be concentric with the outer annulus. The central conduit can be biased toward one side of the annulus. Another aspect of the invention relates to having more than two burner conduits whereby one conduit is completely enclosed by another which is further enclosed by another, or multiple adjacent but non-enclosing conduits are completely enclosed by a larger annulus. In such an example, a small portion of the fuel can be directed through a central conduit which is surrounded by an annular conduit flowing the oxidant which is further enclosed by another annular conduit for the balance flow of fuel.

Referring now to FIG. 1, FIG. 1 is a schematic drawing of an aspect of a burner than can be employed in the instant invention. Outer pipe or conduit 1 defines flange 3 and a detent 5 that defines an angled opening 7. Pipe 1 also defines a coupler 9 that is connected to a fuel supply (not shown). Pipe 2 defines a flange 4 and a detent 7 that defines an angled opening 8. Pipe 2 also defines a diffuser plate 6, and a coupler 9 that is connected to an oxidant supply (not shown). The burner is assembled by positioning inner conduit or pipe 2 within outer pipe or conduit 1. A gasket or grommet 10 is positioned between flanges 3 and 4 in order to provide a fluid seal between pipes 1 and 2. The relative position of pipe 2 within pipe 1 is maintained by dowel or pin 11.

The inventive burner and method can be used in any suitable furnace such as rotary or reverbatory furnaces; among other furnaces that are known in this art. Similarly, the burner can be positioned at any desirable location with respect to the furnace.

While the inventive burner can be operated in any desirable manner, the placement of fuel so as to shield the charge from an oxidant (e.g, the fuel is supplied on the outside of oxidant), typically changes the flame and gaseous current flow patterns within the furnace in comparison to conventional burners. The fuel is also lighter than other gases in the furnace. As a result and if the burner is not properly designed, the fuel in the annular flow can loft upwardly once in the hot furnace thereby leaving a jet of pure oxidant exposed to the load inside the furnace. This possible scenario is even more pronounced if the furnace has a double-pass configuration when the lofting fuel flow can easily escape out of the furnace via a short circuit with the flow of the flue gas.

In some cases, the oxidant flow rate is several multiples of that of the fuel, a ratio called combustion stoichiometry which is defined as the ratio of the molar flow rate of the oxidant over that of the fuel wherein the oxidant flow contains all the gases that are compositionally parts of the oxidant in addition to oxygen. For example, the stoichiometry for complete combustion of methane ranges from about 2 in the case of full oxy-fuel combustion to close to about 10 in air-fuel combustion due to the presence of nitrogen and other trace gases in air. When the fuel goes through the outside annulus or conduit of the burner instead of the oxidant, the thickness of the annulus can be significantly reduced even at the same gas velocities thereby rendering the annular fuel flow much less effective in shielding the central oxidant jet.

In general, the oxidant velocity in the center conduit of the burner should be relatively high while the fuel velocity on the outside should be relatively low. The faster oxidant flow pulls the slower fuel flow along thereby preventing rapid fuel dissipation to the ambient. The velocity differential between the fuel and oxidant also ensures a progression of combustion which consumes the oxidant in a controlled manner along the way. The velocity ratio, however, is usually maintained within a range as dictated by the ratio of R/r, where R is the radius of the fuel nozzle on the outside and r is the radius of the oxidant nozzle in the center (e.g., so that the oxidant can be shielded with the fuel until reacted). The velocity of the oxidant in the center is $v_o=F_o/\pi r^2$, and the velocity of the fuel on the outside is $v_f=F_f/\pi(R^2-r^2)$, whereby the oxidant flow rate $F_o$ equals x times the fuel flow rate $F_f$ where x depends on the combustion stoichiometry. The oxidant to fuel velocity ratio $v_o/v_f=x(R^2-r^2)/r^2$ for this invention is typically between about 1 and about 5. A ratio of lower than about 1 (i.e., fuel faster than oxygen), can lead to a rapid loss of the fuel shielding layer through turbulent gas diffusion and entrainment as a result of the over-thinning of the fuel annulus. A ratio greater than about 5 can result in a fuel velocity too low to maintain a coherent annular layer for a substantial distance downstream the burner nozzle outlet. The fuel flow in these cases can loft upwardly and be swept away by furnace gas flow patterns. An oxidant to fuel ratio that is too high or too low can both lead to an undesirable result of exposing a relatively pure oxidant jet or stream along at least a portion of the length of flame. Typically, a desirable fuel to oxygen ratio is obtained by satisfying the following criterion: $[(1+x)/x]^{1/2}<R/r<[(5+x)/x]^{1/2}$.

In one aspect of the invention, a slightly converging burner nozzle can overcome the tendency of a jet of fuel or oxidant to expand immediately upon exiting the nozzle. Typically the angle of convergence should be between about 0° and about 15° with respect to the burner axis. In some cases, the angle is between about 4° and about 9° in order to avoid the possibility of excess turbulence resulting from the flow transition. In some additional or other cases, it is desirable to have an angle of convergence on both oxidant and fuel. Further, in some cases, it is useful for the angle of convergence with respect to the burner axis for the fuel nozzle on the outside to be no less than that of the angle of convergence for the oxidant nozzle in the center with respect to the burner axis (e.g., to minimize expansion of the fuel gas flow while still inside the burner nozzle).

In another aspect of the invention, the fuel nozzle of the burner does not terminate before the oxidant nozzle (e.g., otherwise, the fuel may not form a shield around the oxidant jet or the oxidant nozzle may be damaged). It is typically useful to keep the flows streamlined so as to maintain the shield of the fuel around the oxidant. Usually, an offset of less than about 1 inch is useful between the fuel and oxidant nozzles (e.g., less than about 0.5 inch).

In one aspect of the invention, the inventive burner is employed in a double-pass long furnace, wherein the flue gas exhaust port is placed on the same side of the burner, and in many cases above the burner. The flame in such a furnace is intended to extend to the opposite end of the furnace before turning around and heading toward the flue. Therefore, the gases exiting the burners must have sufficient momentum to overcome the flow of the returning furnace gases and maintain the momentum for the length of the furnace. The gas exit velocities can be relatively high in this aspect of the invention; such as between about 150 and about 250 feet per second. The velocity ratio $v_o/v_f$ between the oxidant and fuel can be on the lower end of the range, typically below about 1.5 in order to maintain a high fuel velocity. The low velocity differential between the oxidant and the fuel but the high velocity differential between the fuel and the furnace gases may not be conducive to the retention of the fuel layer around the oxidant. To compensate, the angle of intersection between the fuel and oxidant flows can be increased to have a convergence in the oxidant nozzle, but to have a maximum angle of convergence for the fuel nozzle while still preserving most of the fuel flow streamlines. A useful angle of convergence for the fuel nozzles is about 7° to about 15° with respect to the burner axis. Minimum nozzle offset (e.g., less than ½ inch), can be employed in this aspect in order to avoid adding excess turbulence caused by pre-combustion.

In another aspect of the invention, the inventive burner is employed in a single-pass long furnace, wherein the prevailing flow issuing from the burner exits the furnace through a flue gas exhaust port on the opposite side of the furnace and without making additional turns. In this aspect, the gas velocities can be lower than those appropriate for double-pass furnaces, typically between about 50 and about 150 feet per second. The velocity ratio $v_o/v_f$ between the oxidant and fuel can be on the higher end of the range (e.g., greater than about 2), in order to provide sufficient velocity differential for good mixing between the oxidant and the fuel to complete the combustion before the flows exit the furnace. Because of the relatively low forward velocity of the fuel, the angle of intersection of the two streams can be minimized. A desirable angle of convergence for the oxidant nozzle is less than about 9° (e.g., so as not to disturb the flow streamlines), while a useful angle of intersection between the fuel and oxygen flows is typically no more than about 5°.

In another aspect of the invention, a rotary furnace is operated in a manner to reduce the amount of oxidant adjacent to the charge. The reduced amount of oxidant adjacent to the charge reduces the amount of charge that is oxidized when heated and in turn increases the amount of metal products produced by the furnace.

For other type of furnace designs where the flue gas exhaust port is neither directly above the burner nor directly opposite the burner, the broader criteria as outlined above can be applied.

Without wishing to be bound by any theory or explanation, the table below summarizes certain design parameters that can be employed for maximizing the effectiveness of the inventive burner and usage thereof for different type of furnaces.

TABLE 1

| | Single-Pass Furnace | Double-Pass Furnace | Other Furnace |
|---|---|---|---|
| Fuel velocity (ft/s) | 50-150 | 150-250 | 50-250 |
| Oxidant velocity (ft/s) | 50-150 | 150-250 | 50-250 |
| $V_o/V_f$ | 2-5 | 1-1.5 | 1-5 |
| Oxidant nozzle angle w.r.t. axis | 0°-9° | 0° | 4°-9° |
| Fuel nozzle angle w.r.t. oxidant | 0°-5° | 7°-15° | 0°-7° |
| Nozzle offset (inches) | 0-0.5 | 0-0.5 | 0-0.5 |

The following Examples are provided to illustrate certain aspects of the invention and shall not limit the scope of the claims appended hereto.

EXAMPLE 1

The burner illustrated in FIG. 1 was evaluated by using computational fluid dynamics ("CFD") techniques with FLUENT® software. The following table lists certain aspects of the burner that are varied during the evaluation and their respective affects.

TABLE 2

| Adjustability | Range | Parameters Affected |
|---|---|---|
| Oxygen pipe size | 2.5", 3", 3.5" | $O_2$ and NG velocities |
| Natural gas nozzle angle | 0°, 7.5°, 15° | NG velocity and direction |
| NG/$O_2$ nozzle offset | 0", 1" | Flame stability |

Figure 2:
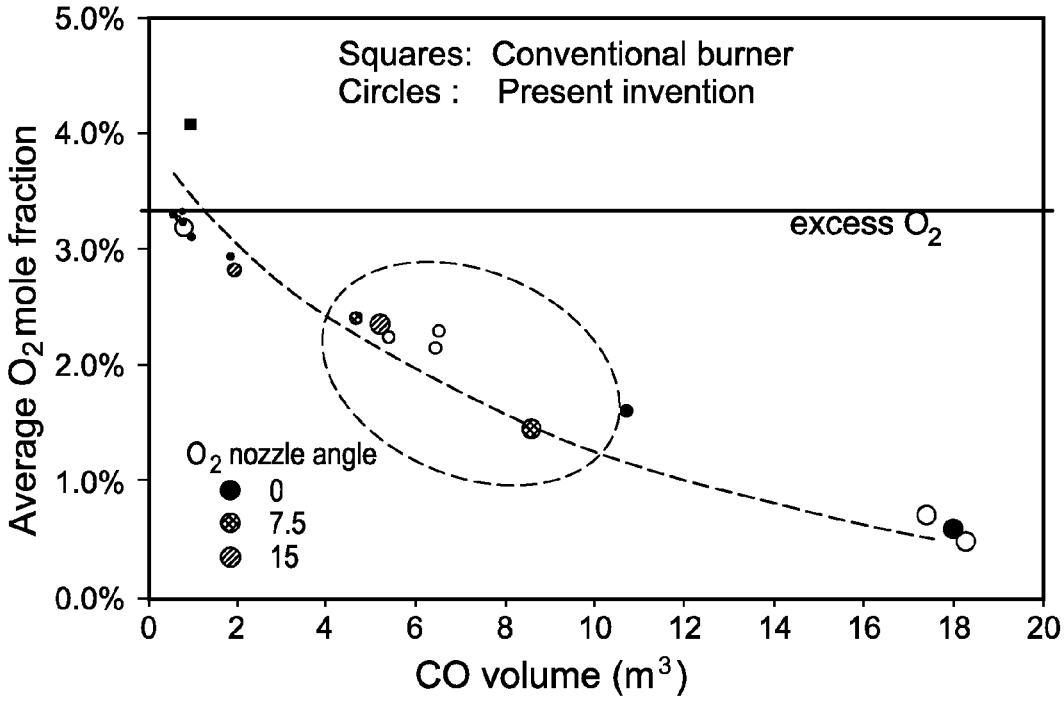
FIG. 2 is a graphical illustration of the CO volume v. average oxygen mole fraction as determined by computer modeling.

Referring now to FIG. 2, FIG. 2 is a collection of CFD model results of different burner configurations plotting the average $O_2$ concentration at the melt surface vs. the volume of the CO plume. FIG. 2 illustrates that there is a strong correlation or relationship between the two parameters (e.g., the parameters are inversely related).

Figure 3:
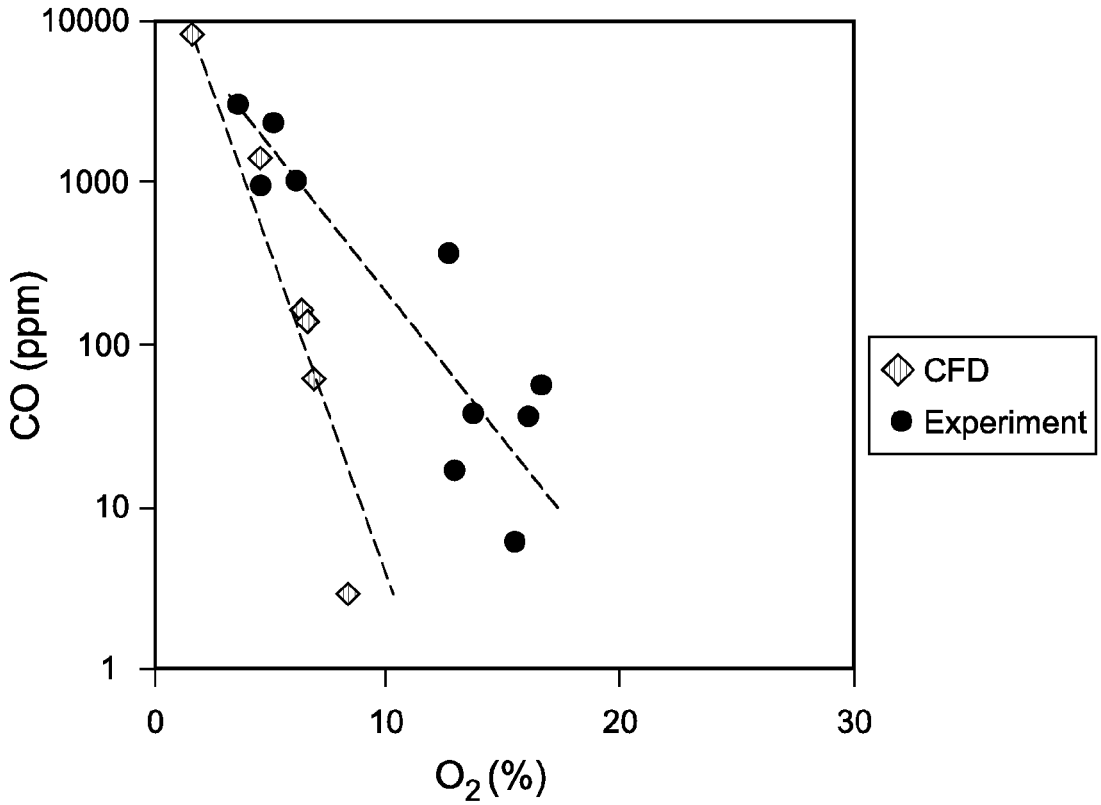
FIG. 3 is a graphical illustration of the oxygen percentage v. CO as determined by computer modeling and experimental data.

Referring now to FIG. 3, FIG. 3 illustrates that the relationship shown in FIG. 2 was confirmed by experimental data (i.e., the inverse relationship between CO and $O_2$ concentrations). The experimental data was generated by real-time probing of the gas composition 2 feet directly under the flame at various furnace depths in a single-pass laboratory furnace for about 2 minutes for each data point under stable burner firing and furnace temperature conditions. The unit of measure of CO in FIG. 3 is different from that in modeling because only point concentrations can be measured in experiments. The scale of the $O_2$ concentration measured was also relatively larger than the modeling results due to the sampling location being closer to the flame than modeled and due to the fact that the measurements are from dry samples after removing the moisture in the gas which can be significant in oxy-fuel combustion.

The utility of increased CO volume (i.e. higher CO concentration in order to reduce oxidation of the underlying charge or molten material), was evaluated against the burner design; in particular the fuel nozzle angle. The central region of the curve in FIG. 2 is a desirable operating regime. As can be seen, the fuel or natural gas ("NG") nozzle angle with most of the points inside the curve is that of about 7.5°.

The length of the nozzle offset can determine the amount of pre-combustion, which in turn can determine the size of the flame. To reduce the free $O_2$ concentration, it is useful to control the O2 concentration such that the $O_2$ preferentially mixes and reacts with NG. NG is in effect sandwiched by a high velocity oxygen jet on the inside and a much slower-moving layer of furnace gases on the outside. If the natural gas mixes preferentially with the oxygen over the furnace gases, rapid oxygen consumption will ensure a minimally oxidizing environment. However, if the natural gas preferentially mixes with the furnace gases, the consumption of oxygen is slowed and the flows may segregate exposing a highly concentrated oxygen jet. In the turbulent flow regime, mixing of these streams can be correlated by the degree of momentum transfer, which is a function of the velocity difference.

In order to determine the effect of $O_2$ pipe size, the following experiment was conducted by holding NG nozzle angle and offset constant.

TABLE 3

| | $O_2$ pipe size | NG nozzle angle | Nozzle offset |
|---|---|---|---|
| Test "cab" | 3.5" | 0° | 1" |
| Test "bab" | 3" | 0° | 1" |
| Test "aab" | 2.5" | 0° | 1" |

In order to determine the effect of nozzle angle and offset, the following experiment was conducted by holding the O2 pipe size constant.

TABLE 4

| | $O_2$ pipe size | NG nozzle angle | Nozzle offset |
|---|---|---|---|
| Test "bab" | 3" | 0° | 1 |
| Test "bca" | 3" | 15° | 0 |
| Test "bba" | 3" | 7.5° | 0 |
| Test "bbb" | 3" | 7.5° | 1 |

Figure 4:
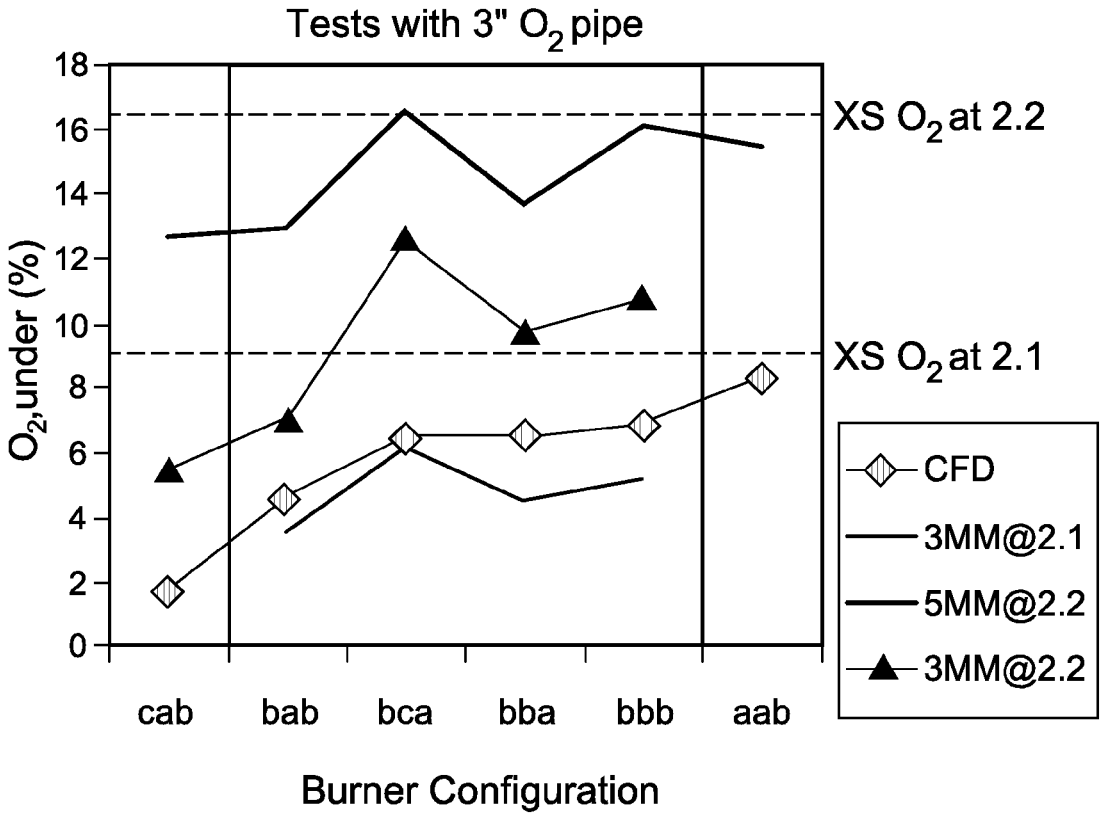
FIG. 4 is a graphical illustration of the angle of the natural gas nozzle v. oxygen concentration.
Figure 5:
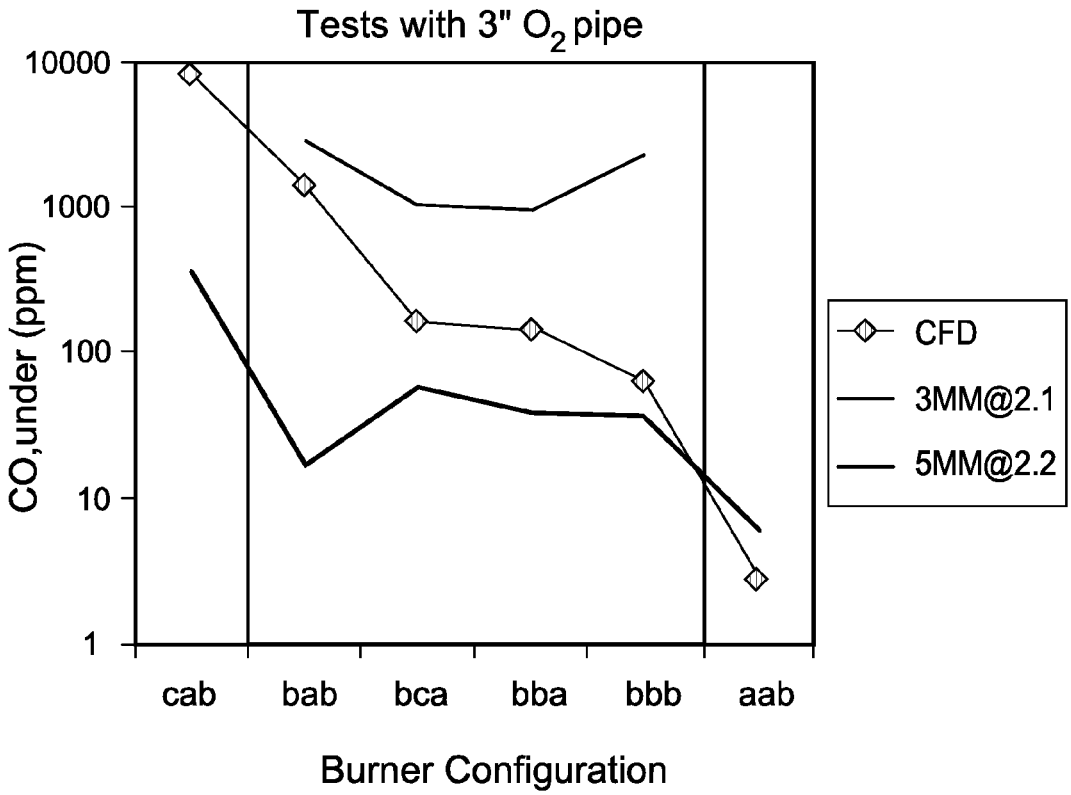
FIG. 5 is a graphical illustration of inventive burner configurations v. oxygen.

Referring to FIGS. 4 and 5, FIGS. 4 and 5 summarize the previously described experimental results along with the CFD predictions for comparison. As can be seen in the graphs, the experimental trend corresponds generally the CFD results. The first data point on the graphs is from the 3.5" oxygen pipe, and the last from the 2.5" oxygen pipe. The points in between are from the 3" oxygen pipe.

The effect of the oxygen pipe on the CO and $O_2$ concentration was confirmed. The use of 3" and 3.5" oxygen pipes typically leads to relatively lower $O_2$ or higher CO. The experimental results obtained by evaluating the 3" oxygen pipes indicates that the oxygen measurements correspond with the NG nozzle angle (e.g., a larger NG angle leads to higher $O_2$ concentration). The lab results on CO are diverging on the two sets of data. In order to balance, CO concentration and O2 concentration, a median NG angle of 7.5° is desirable.

An evaluation of the experimental results for configurations "bba" and "bbb" indicates that the affect of nozzle offset on CO and $O_2$ concentrations. These results indicate that there is a trend of higher $O_2$ concentration with larger offset was shown, and diverging results on CO concentration.

Figure 6:
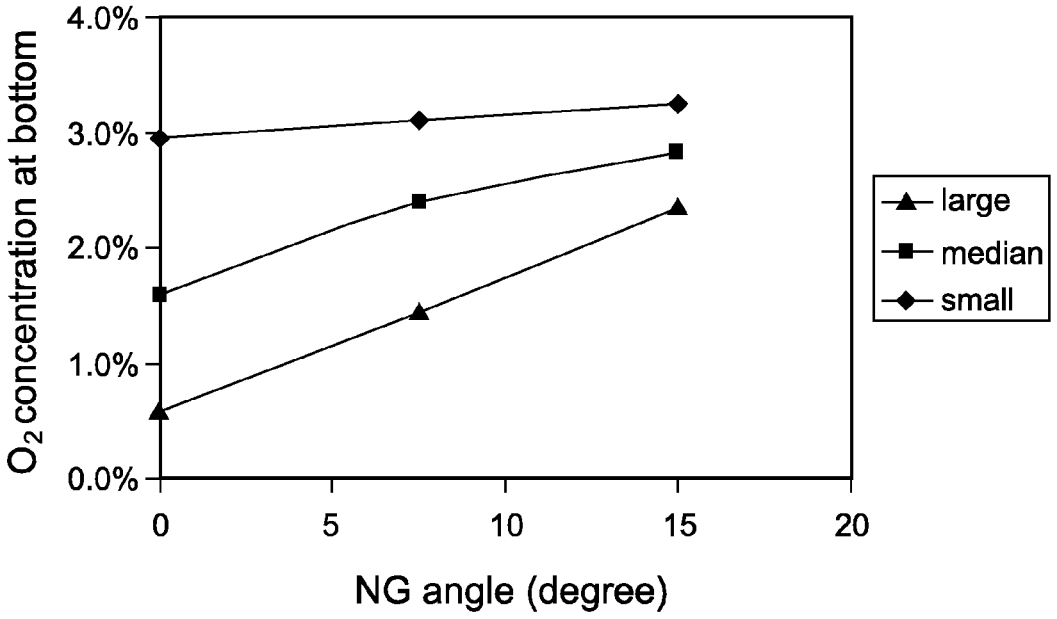
FIG. 6 is a graphical illustration of inventive burner configurations v. oxygen.

After determining effective fuel nozzle characteristics, the oxygen pipe size can be evaluated and selected. Referring now to FIG. 6, FIG. 6 illustrates that for a 1" nozzle offset, larger $O_2$ pipe sizes lead to lower $O_2$ concentration at the melt surface and confirms that the following two burner configurations are effective at supplying heat to an underlying charge or melt and minimizing oxidation of the charge for a burner firing between 5-10 MMBtu/hr:

Configuration 1: NG nozzle 7.5°, 3" $O_2$ pipe, offset=0.5"

Configuration 2: NG nozzle 7.5°, 3.5" $O_2$ pipe, offset=1"

In connection with configuration 1, the smaller $O_2$ pipe size can result in a relatively high $O_2$ velocity and relatively low NG velocity. Therefore, the momentum transfer between the NG and $O_2$ is significant compared to that of NG and the furnace gases thereby providing a minimally oxidizing environment. The inventive burner in this configuration can be operated with minimal pre-combustion, which permits employing an 0.5" nozzle offset.

In connection with configuration 2, the larger $O_2$ pipe size can reduce the $O_2$ velocity while increasing the NG velocity. The velocity difference between NG and $O_2$ diminishes compared to the increased driving force of momentum transfer between NG and the furnace gases. Therefore, a 1" nozzle offset can be employed in order to cause a relatively large amount of pre-combustion to promote the mixing between NG and $O_2$ and in turn provide a minimally oxidizing environment to the melt in the furnace.

EXAMPLE 2

CFD (Computational Fluid Dynamics) simulations were used to show the combustion inside a rotary furnace that reduces the amount of oxygen adjacent to the charge surface. In particular, the oxygen concentration at the charge surface is compared for two different burners, one with conventional design while the other with the burner of FIG. 1. The conventional design burner comprises a co-axial type burner where a circular fuel passage in the center is surrounded by an annulus of oxygen flow. The firing rate in this simulation is 10 mmbtu/hr with methane as the fuel and oxygen as the oxidizer. The stoichiometric ratio (volume ratio of oxygen to fuel) is 2.0. The CFD software, Fluent (version 6.3, ANSYS Inc), is used for the simulation.

Figure 7:
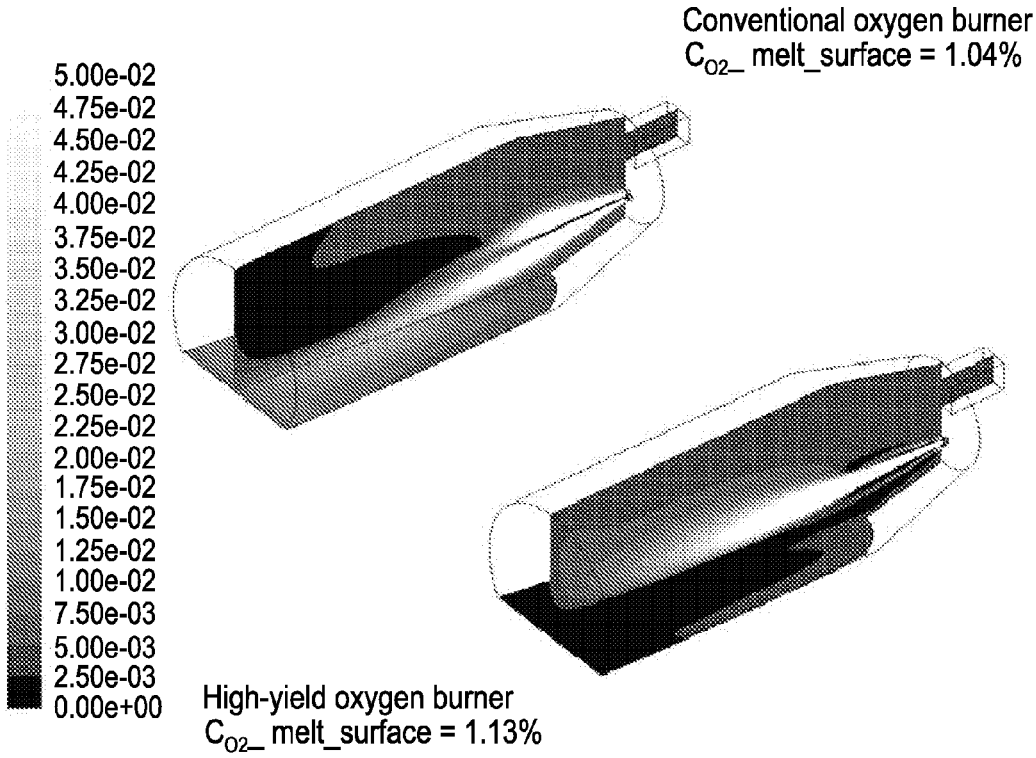
FIG. 7 is a graphical illustration of oxygen concentration within a rotary furnace.

Referring now to FIG. 7, FIG. 7 shows the oxygen concentration inside the rotary furnace in the gas phase immediately above the metal in terms of the mole fraction of oxygen in the gas composition as shown on the left hand side axis of FIG. 7. In a conventional burner, the fuel is introduced to the furnace through a center passage, while the oxygen is introduced through an annulus surrounding the central fuel pipe. Since fuel and oxygen need some distance to mix and react, there is potential to have some oxygen left at the melting furnace. In this specific simulation of a conventional burner, the average oxygen concentration at the melting surface is about 1.04%. When the burner of FIG. 1 is modeled, the oxygen is introduced in the center while the fuel enters the system in a surrounding annulus. As a reduction agent, the fuel helps to separate or separate the oxygen from the charge of melting metal. In this specific simulation of the inventive burner, the average oxygen concentration at the melting surface is about 0.13%, an eight times reduction from the case with conventional burner.

The gas phase composition immediately adjacent to the melt surface is summarized in Table 5 for the two burner designs.

TABLE 5

Gas composition immediately above the melt surface in a rotary furnace as modeled by FLUENT.

| | Conventional burner | Present invention |
|---|---|---|
| H2O | 65.8% | 65.83% |
| CO2 | 32.94% | 32.77% |
| O2 | 1.04% | 0.13% |
| H2 | 0.14% | 0.73% |
| CO | 0.08% | 0.54% |

Chemical equilibrium calculations are conducted using the thermochemical software FactSage™ version 6.1 on various non-ferrous metals exposed to the atmospheres shown in Table 5 at process temperatures slightly above their respective melting points. It was assumed that there was enough metal to allow the metal oxidation reactions to go to completion. The results are presented in Table 6 for a total of 100 mol of gases.

TABLE 6

Amount of metal oxide formed at reaction equilibrium in every 100 mol of gases for various non-ferrous metals.

| | Melting point (° C.) | Temperature for calculation (° C.) | Metal oxide conventional Mol | Metal oxide present invention mol | Difference mol |
|---|---|---|---|---|---|
| Al | 660.6 | 670 | 44.61 | 44.06 | 0.56 |
| Cu | 1083.3 | 1100 | 1.87 | 0 | 1.88 |
| Pb | 327.2 | 335 | 1.86 | 0 | 1.86 |
| Zn | 419.4 | 430 | 133.84 | 132.17 | 1.67 |

As clearly demonstrated in Table 6, the gas composition in the combustion space adjacent to the hot metal surfaces in a furnace running the burner design disclosed in this invention (high yield burner) can lead to a lower degree of metal oxidation for every one of the four non-ferrous metals investigated.

The present invention is not to be limited in scope by the specific aspects or embodiments disclosed in the examples which are intended as illustrations of a few aspects of the invention and any embodiments that are functionally equivalent are within the scope of this invention. Various modifications of the invention in addition to those shown and described herein will become apparent to those skilled in the art and are intended to fall within the scope of the appended claims.

The invention claimed is:

1. A process for heating a charge of material comprising:

providing a charge of material to be heated, combusting a fuel and an oxidant by using a burner comprising at least two co-axial conduits wherein the oxidant is supplied by a first conduit and the fuel is supplied by a second conduit and the second conduit surrounds the first conduit thereby shielding oxidant from the charge and providing a fuel rich zone adjacent the charge, heating the charge by radiant and convective transfer of heat from the combustion to the charge, and;

recovering heated material.

2. The process of claim 1 wherein the charge comprises at least one member selected from the group consisting of aluminum, iron, lead, nickel, tin and zinc; and the charge is heated to an elevated temperature.

3. The process of claim 1 wherein the charge is provided to a member selected from the group consisting of a rotary, reverbatory and a stack melting furnace.

4. The process of claim 1 wherein the charge is provided to a single pass furnace.

5. The process of claim 1 wherein the charge is provided to a double pass furnace.

6. The process of claim 1 wherein the fuel comprises at least one member selected from the group consisting of gaseous, liquid and solid fuels.

7. The process of claim 1 wherein the oxidant comprises oxygen enriched air or oxygen.

8. The process of claim 7 wherein the fuel nozzle has an angle of about 7 to 20 degrees with respect to a burner axis that extends longitudinally.

9. The process of claim 7 wherein the oxidant nozzle has an angle of less than about 9 degrees with respect to the burner axis that extends longitudinally.

10. The process of claim 1 wherein the burner has dimensions that satisfy: $[(1+x)/x]^{1/2}<R/r<[(5+x)/x]^{1/2}$ where R is the radius of a fuel nozzle and r is the radius of an oxidant nozzle and x is the ratio of oxidant to fuel.

11. The process of claim 1 wherein the concentration of oxidant adjacent to the charge is less than about 1.0% by volume.

12. A process for heating a charge of material comprising:

providing a charge of material to be heated, combusting a fuel and an oxidant by using a burner wherein the oxidant is supplied to the burner in a manner such that the fuel substantially surrounds the oxidant thereby shielding oxidant from the charge and providing a fuel rich zone adjacent the charge, heating the charge by radiant and convective transfer of heat from the combustion to the charge, and;

recovering heated material and wherein the charge is provided to a double pass furnace.

13. A process for heating a charge of material comprising:

providing a charge of material to be heated, combusting a fuel and an oxidant by using a burner having a co-axial configuration wherein the oxidant is supplied to the burner through a first conduit that is completely surrounded by a second conduit that supplies fuel to the burner thereby shielding oxidant from the charge and providing a fuel rich zone adjacent the charge, heating the charge by radiant and convective transfer of heat from the combustion to the charge, and;

recovering heated material.

* * * * *